United States Patent [19]

Kokubun

[11] 4,292,879

[45] Oct. 6, 1981

[54] HOOK ASSEMBLY FOR SPRING TENSION CARRIER IN BRAIDING MACHINE

[75] Inventor: Shusuke Kokubun, Shizuoka, Japan

[73] Assignee: Kokubun Inc., Shizuoka, Japan

[21] Appl. No.: 149,055

[22] Filed: May 12, 1980

[51] Int. Cl.[3] ..... D04C 3/18; B65H 59/04

[52] U.S. Cl. ..... 87/57; 87/56; 242/147 R; 242/156; 252/157 R

[58] Field of Search ..... 87/22, 56, 57, 61; 242/147 R, 157, 154, 156, 156.1, 156.2, 157 R, 157.1

[56] References Cited

U.S. PATENT DOCUMENTS

| | | | |
|---|---|---|---|
| 623,514 | 4/1899 | Cabezola | 87/56 |
| 2,068,945 | 1/1937 | Cook | 87/57 |
| 2,437,539 | 3/1948 | King | 87/22 |
| 2,448,312 | 8/1948 | Hobourn et al. | 87/57 |
| 2,579,142 | 12/1951 | Ferruta | 87/22 |
| 2,704,958 | 3/1955 | Groh | 87/56 |
| 2,718,810 | 9/1955 | Groh | 87/56 |
| 3,276,310 | 10/1966 | Radlauer | 87/22 |

*Primary Examiner*—John Petrakes
*Attorney, Agent, or Firm*—Jordan and Hamburg

[57] ABSTRACT

A spring tension carrier in a braiding machine comprising a main body adapted to move on a base of the braiding machine, and bobbin rotatably mounted on the main body and having a ratchet on the bottom, a stopper lever pivoted to the main body and having a pawl adapted to engage and disengage from the ratchet, a vertical operation frame guide rod extending from the main body, a spring loaded operation frame operatively connected at the lower end to the stopper lever for movement along the guide rod, an intermediate thread guide mounted on the guide rod for guiding one end of the threaded payed out of the bobbin, a hook support rod extending uprightly from the main body in parallel to the operation frame guide rod, a hook assembly mounted on the hook support rod, a spring mounted on the hook support rod to act on the hook assembly and a second thread guide attached to the upper end of the operation frame guide rod.

9 Claims, 6 Drawing Figures

HOOK ASSEMBLY FOR SPRING TENSION CARRIER IN BRAIDING MACHINE

BACKGROUND OF THE INVENTION

This invention relates generally to a spring tension carriers of braiding machines and more particularly, to a weighted hook assembly for such spring tension carrier.

Spring tension carriers of a high speed braiding machines generally includes an intermediate thread guide along which one end of a thread payed out of the thread bobbin is guided, a weighted hook provided downstream of the intermediate thread guide in the path of the thread to guide the thread from the intermediate thread guide and along the hook portion of a curved and a second thread guide provided downstream of the hook in the path of the thread to guide the thread from the hook and to the braiding mechanism of the braiding machine where the thread is braided together with other threads which are guided by the other similar spring tension carriers in the same braiding machine. In the conventional spring tension carrier in a braiding machine, the weighted thread guiding hook has been conventionally formed of a length of snail wire or by bending a piece of steel plate into a hook shape and then plating the snail wire or bent steel plate with chrome or copper. The hook is then mounted on a weight. However, the conventional hook has the disadvantage that when the braiding machine is operated at a high speed, the hook becomes worn prematurely and as a result, the hook has a short service life.

SUMMARY OF THE INVENTION

Therefore, the present invention is to solve the problem inherent in the prior art thread guide hook for spring tension carriers of a braiding machine.

The purpose of the present invention is to provide a novel and improved hook assembly which comprises a hook formed of wear resistant material such as porcelain or super-hard alloy and a substantially U-shaped weight which receives the hook therein for easy replacement.

The above and other objects and attendant advantages of the present invention will be more readily apparent to those skilled in the art from a reading of the following detailed description in conjunction with the accompanying drawing which shows preferred embodiments of the invention for illustration purpose only, but not for limiting the scope of the same in any way.

BRIEF DESCRIPTION OF THE DRAWING

The accompanying drawing shows preferred embodiments of the thread hook assembly for a spring tension carrier a braiding machine constructed in accordance with the present invention in which.

PREFERRED EMBODIMENTS OF THE INVENTION

Figure 1:
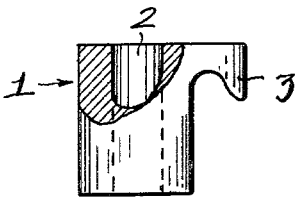
FIG. 1 is a side elevational view of the hook component of one embodiment of the thread hook assembly of the invention with a portion thereof broken away.
Figure 2:
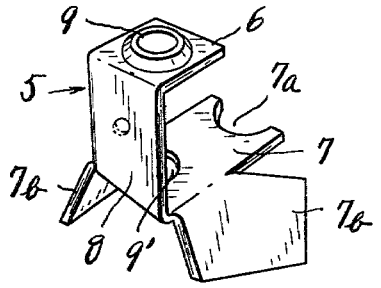
FIG. 2 is a perspective view of the weight component of said one embodiment of the thread hook assembly shown in FIG. 3.
Figure 3:
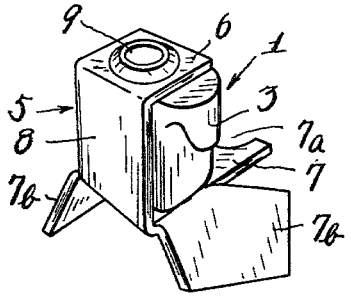
FIG. 3 is a perspective view of said first embodiment of thread hook assembly showing the hook and weight component in their assembled condition.

The present invention will be now described referring to the accompanying drawing and more particularly, to FIGS. 1 through 3 in which the first embodiment of the thread hook assembly of the invention is shown. In FIG. 1, reference numeral 1 denotes the hook which is formed of wear resistant material such as porcelain or super-hard alloy and has a vertical through hole 2 and a hook portion 3 which first extends horizontally from the top of the body of the hook and then bends downwardly in parallel to the hook body so as to define a smoothly curved recess in the undersurface of the hook portion 3 for guiding a thread therealong. The hook 1 is adapted to be received in a substantially U-shaped weight 5 as shown in FIGS. 2 and 3.

The weight 5 is formed by bending a length of metal plate into a substantially U-shaped construction to provide a relatively short upper leg 6, a longer lower leg 7 which extends in parallel to and spaced from the shorter upper leg 6 and an intermediate vertical portion 8 which integrally connects the shorter and longer legs 6, 7 together. The lower leg 7 is provided with a semicircular recess *7a* at the free end and a pair of blades *7b*, *7b* on the opposite sides of the lower leg 7. The blades *7b*, *7b* are formed by bending extensions on the opposite sides of the lower leg 7 downwardly at an angle to the plane of the leg 7. The upper and lower legs 6, 7 are provided with aligned through holes 9, 9', respectively. The hook 1 is received in the weight 5 with the through hole 2 in the hook body in alignment with the aligned holes 9, 9' in the upper and lower legs 6, 7 of the weight 5, respectively to provide the hook assembly as shown in FIG. 3. The thus obtained hook assembly 1, 5 is slidably received on a vertical rod 21 in a spring tension carrier of a braiding machine (FIG. 6) for upward and downward movement along the rod 21 by passing the rod 21 through the aligned holes 2 and 9, 9' in the hook 1 and weight 5, respectively.

Figure 4:
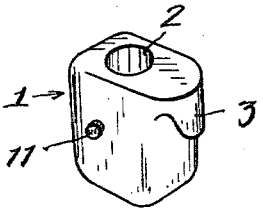
FIG. 4 is a perspective view of the hook component of a modified embodiment of the thread hook assembly of the present invention.
Figure 5:
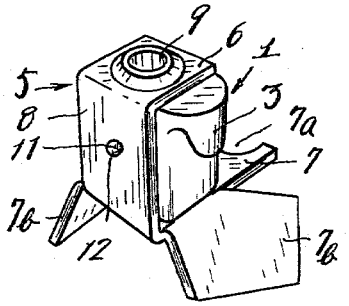
FIG. 5 is a perspective view of the modified embodiment of the thread hook assembly showing the hook and weight component in their assembled condition.

Referring now to FIG. 4 in which a modified hook of the modified hook assembly of the invention is shown, the modified hook is substantially identical with the hook as shown in FIGS. 1 through 3 except that the modified hook is provided with a projection 11 on one face of the hook body adjacent to the body face where the hook portion 3 is formed. FIG. 5 shows the modified or second embodiment of the hook assembly which comprises the modified hook 1 of FIG. 5 and the modified weight 5. The modified weight 5 is substantially identical with the weight of FIGS. 1 through 3 except that the modified weight is provided with a through hole 12 for receiving the projection 11 on the modified hook whereby the hook is precisely positioned within the weight 5.

Figure 6:
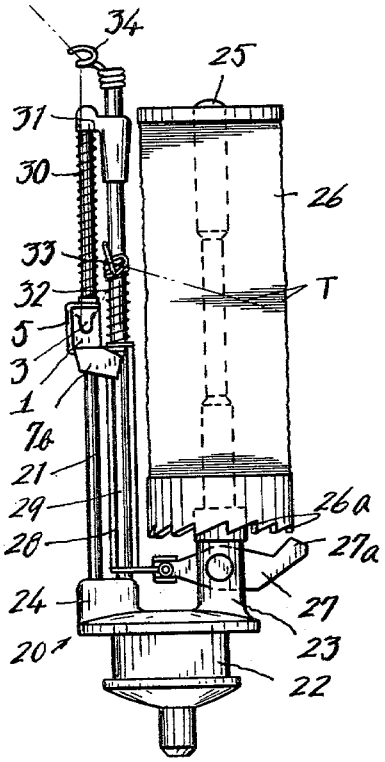
FIG. 6 is a front elevational view of a spring tension carrier of a braiding machine in which the thread hook assembly of the invention is incorporated.

FIG. 6 shows one of the spring tension carriers of a braiding machine in which the hook assembly 1, 5 of the invention is incorporated. The carrier substantially comprises a main body 20 having a substantially leaf-shaped portion 22 having opposite pointed ends and adapted to move slidably along the meandering groove (not shown) formed in the base (not shown) of the braiding machine. The main body 20 further includes first and second upright projections 23, 24 integrally formed with and extending upwardly from the top of the main body for the purpose to be described hereinbelow. A bobbin support shaft 25 is supported at the lower end thereof on the first projection 23 and extends uprightly from the projection in parallel to the rod 21. A bobbin 26 is rotatably mounted on the bobbin support shaft 25 and provided on the undersurface thereof with a ratchet 26*a*. A length of thread T is wound about the bobbin 26 to be payed out of the bobbin in the conventional manner. A stopper lever 27 is pivoted at a mid-point between the opposite ends thereof to the first projection 23 and has a pawl 27*a* at one end adapted to engage and disengage from the ratchet teeth 26*a* of the bobbin 26. A substantially U-shaped operation frame 28 is operatively connected at its lower end to the other end of the stopper lever 27 and has aligned holes (not shown) in the opposite vertically spaced upper and lower legs of the U-shaped configuration. The blades 7*b* of the lower leg 7 of the weight 5 engage the undersurface of the upper leg of the operation frame 28 as can be seen on FIG. 6. A guide rod 29 projects uprightly from the second projection 24 on the main body 20 in parallel to the shaft 25 and rod 21. Guide rod 29 extends through the aligned holes in the legs of the frame. The rod 29 is partially surrounded by the semicircular recess 7*a* in the lower leg 7 of the weight 5.

A spring 30 is disposed on the rod 21 in a compressed condition between the hook assembly 1, 5 and a rod support 31 which is fitted on the rods 21 and 29. A second spring 32 is disposed on the rod 29 in compression between the upper leg of the operation frame 28 and an intermediate thread guide 33 fitted on the rod 29 below the rod support 31. A second thread guide 34 is attached to the extreme upper end of the guide rod 29.

In operation, when one end of the thread T is under tension and payed out of the bobbin 26 which is now rotating and passed sequentially through the thread guide 33, the smoothly curved recess in the hook 1 of the hook assembly 1, 5 and the second thread guide 34 to the braiding mechanism of the braiding machine (not shown) where the thread is braided together with other threads from the other similar spring tension carriers (not shown) in the same braiding machine, the thread T under tension pushes the hook assembly 1, 5 upwardly against the force of the spring 30. The pushed-up hook assembly then pushes the operation frame 28 upwardly against the force of the spring 32 by virtue of the engagement of blade 7*b* with the upper leg thereof to thereby pivot the stopper lever 27 operatively connected to the operation frame 28 in a clockwise direction to disengage the pawl 27*a* from the ratchet 26*a* on the bobbin 26.

With the above-mentioned construction and arrangement of the parts of the spring tension braiding carrier in which the hook assembly of the invention is incorporated, when the braiding machine is operated at a high speed, the thread T which is in frictional contact with the hook portion 3 of the hook 1 moves upwardly and downwardly together with the hook assembly 1, 5 and is always guided along the hook portion 3. The hook portion 3 is thus subjected to more severe wear and tear than the wear and tear to which the other thread guides are subjected by the thread. However, according to the present invention, the hook body and hook portion are integrally formed of wear-resistant material such as porcelain or super-hard alloy, the hook enjoys a long service life and can be easily and promptly replaced by a new hook when the hook now in use has become worn. As a result, the carrier enjoys a long service life.

While only two embodiments of the invention have been shown and described in detail, it will be understood that the same are for illustration purpose only and not to be taken as a definition of the invention, reference being had for this purpose to the appended claims.

What is claimed is:

1. In a spring tension carrier for a braiding machine comprising a main body having a leaf-shaped portion adapted to be guided along a meandering groove in the base of the braiding machine, a bobbin support shaft supported by and extending uprightly from the main body and rotatably mounting a bobbin thereon, the bottom of the bobbin having a ratchet, a stopper lever pivoted at a mid-point between the opposite ends thereof and having a pawl at one end adapted to engage and disengage from the ratchet, an operation frame guide rod supported by and extending uprightly from the main body and having an intermediate thread guide mounted thereon, a substantially U-shaped vertical operation frame mounted on the operation frame guide rod to be guided for movement therealong, the operation frame being operatively connected at the lower end thereof to the other end of the stopper lever, a first spring mounted on the operation frame guide rod in a compressed state between the upper leg of the operation frame and the intermediate thread guide to normally urge the pawl into engagement with the ratchet, a hook assembly support rod supported by and extending uprightly from the main body in parallel relation to the bobbin support shaft and operation frame guide rod, a thread hook assembly mounted on the hook assembly support rod, a rod support member fitted on the operation frame guide rod and hook assembly support rod, and a second spring mounted on the hook assembly support rod in a compressed state between the hook assembly and rod support member, the improvement comprising a hook assembly which comprises a substantially U-shaped weight including a pair of opposed legs having aligned through holes therein adapted to receive the hook assembly support rod and a hook body positioned removably in said weight, said hook body having a through hole alignable with said holes in the legs of the weight, said hook body having a hook portion extending horizontally and then bending downwardly to form a thread guide recess in the underside thereof, said hook body and hook portion being integral and formed of a wear resistant material.

2. The combination as set forth in claim 1, in which said hook body and hook portion are integral and formed of porcelain.

3. The combination as set forth in claim 1, in which said hook body and hook portion are integral and formed of super-hard alloy.

4. The combination as set forth in claim 1, in which said U-shaped weight includes an upper relatively short leg and a longer lower leg extending in parallel and spaced relationship to said shorter upper leg, a semicircular recess being formed at the free end of said lower leg and a pair of side blades formed to extend from the opposite side edges of the lower leg at an angle therewith, an intermediate vertical portion integrally connecting said upper and lower legs together.

5. A hook assembly for a spring tension carrier of a braiding machine comprising a substantially U-shaped weight including a pair of opposed legs, said legs having aligned holes extending therethrough, and a hook body positionable removably in said weight between said legs thereof, said hook body having a through hole therein alignable with the holes in the legs of said weight, said hook body having a hook portion extending horizontally and then bending downwardly to thereby form a thread guide recess in the underside thereof, said hook body and hook portion being integral and formed of a wear resistant material.

6. A hook assembly according to claim 5, in which said hook body and hook portion are integral and formed of porcelain.

7. A hook assembly according to claim 5, in which said hook body and hook portion are integral and formed of super-hard alloy.

8. A hook assembly according to claim 5, in which said U-shaped weight includes an upper relatively short leg and a longer lower leg extending in parallel and spaced relationship to said shorter upper leg, a semicircular recess being formed at the free end of said lower leg and a pair of side blades formed to extend from the opposite side edges of the lower leg at an angle therewith, an intermediate vertical portion integrally connecting said upper and lower legs together.

9. A hook assembly according to claim 5, in which a projection is formed on the face of said hook body adjacent the face having said hook portion, said weight being provided with a through hole in a section thereof connecting said legs, said hole being dimensioned and configured to releasably receive said projection on said hook body.

* * * * *